US005305829A

United States Patent [19]

Kumar

[11] Patent Number: 5,305,829

[45] Date of Patent: Apr. 26, 1994

[54] OIL PRODUCTION FROM DIATOMITE FORMATIONS BY FRACTURE STEAMDRIVE

[75] Inventor: Mridul Kumar, Placentia, Calif.

[73] Assignee: Chevron Research and Technology Company, San Francisco, Calif.

[21] Appl. No.: 951,288

[22] Filed: Sep. 25, 1992

[51] Int. Cl.[5] ..... E21B 43/17; E21B 43/24; E21B 43/26

[52] U.S. Cl. ..... 166/245; 166/252; 166/263; 166/271; 166/272

[58] Field of Search ..... 166/272, 271, 263, 245, 166/303, 252, 250

[56] References Cited

U.S. PATENT DOCUMENTS

| | | | |
|---|---|---|---|
| 3,259,186 | 7/1966 | Dietz | 166/272 X |
| 4,635,720 | 1/1987 | Chen | 166/272 X |
| 4,727,937 | 3/1988 | Shum et al. | 166/272 X |
| 4,828.031 | 5/1989 | Davis | 166/272 |
| 4,986,352 | 1/1991 | Alameddine | 166/272 X |
| 5,085,276 | 2/1992 | Rivas et al. | 166/50 X |

*Primary Examiner*—Stephen J. Novosad
*Attorney, Agent, or Firm*—W. K. Turner; D. J. Power

[57] ABSTRACT

A steam drive method for low permeability formations is described which utilizes a plurality of wellbores in an elongated pattern configuration. The wells initially undergo a cyclic steaming and production operation, wherein as each steaming cycle is initiated a fracture system is created having a heated zone surrounding each fracture. The cyclic steaming and production is repeated until thermal communication between vertical fracture planes is established, and oil recovery through the single well stimulation is significantly reduced. Thereafter, cyclic steaming is halted and new injection wells, centrally situated, are established and used to initiate a steam drive, wherein the heated zone around the fractures helps to reduce the viscosity of and mobilize the hydrocarbons not initially recovered during the cyclic steaming operation.

9 Claims, 3 Drawing Sheets

OIL PRODUCTION FROM DIATOMITE FORMATIONS BY FRACTURE STEAMDRIVE

FIELD OF THE INVENTION

This invention relates to recovering oil from a subterranean oil reservoir by means of an in-situ steam drive process. More particularly, the invention relates to treating a subterranean oil reservoir which is relatively porous and contains a significant proportion of oil, but is so impermeable as to be productive of substantially no fluid in response to injections of drive fluids such as water, steam, hot gas, or oil miscible solvents.

BACKGROUND OF THE INVENTION

Continued worldwide demand for petroleum products, combined with a high level of prices for petroleum and products recovered therefrom, has sustained interest in hydrocarbon sources which are less accessible than crude oil of the Middle East and other geographic regions. Such hydrocarbonaceous deposits range from heavy oil to tar sands, found in western Canada and in the western United States. Depending on the type and depth of the deposit, recovery techniques range from steam injection to in-situ combustion to mining.

For heavy oils in the gravity range of 10 to 20 degrees API, steam injection has been a widely applied method for oil o recovery. Problems arise, however, when attempting to apply this process to subterranean oil reservoirs which even though are relatively porous and contain a significant proportion of oil, are so impermeable as to be productive of substantially no fluid in response to a conventional steam drive application. Such a reservoir is typified by the diatomite formations in the Lost Hills or Cymric Fields which are characterized by depths of about 1000 feet, with thicknesses of about 100 to 300 feet; and having a porosity of about 50%, an oil saturation of about 60%, an oil API gravity between about 13 to 30 degrees, a water saturation of about 40%, and a matrix permeability of less than about 1 millidarcy. These heavy oil formations have been found to yield only a small percentage of their oil content, such as 1% or less, in primary production processes; and have been substantially nonresponsive to conventional types of secondary or tertiary recovery processes.

The literature has seen many attempts aimed at recovering Oil from substantially impermeable types of subterranean formations, such as diatomite, through the use of steam injections techniques. One such method is found in U.S. Pat. No. 4,828,031 to Davis, and assigned to the assignee of the present invention. The method involves the injection of a solvent into the diatomite, followed by injection of a surface active aqueous solution containing a diatomite/ oil-water wettability improving agent, along with a surface tension lowering agent to enhance oil recovery during steam injection.

Another method taught in U.S. Pat. No. 5,085,276 to Rivas, also assigned to the assignee of the present application and incorporated specifically herein by reference, utilizes a series of short steaming cycles at sufficient pressure to induce fracturing of the adjacent formation; alternating with a production cycle which exploits the flashing of the heated formation water from a liquid to steam as wellbore pressures decrease during the transition from the injection to the production cycle. Because the low permeability and high oil viscosity characteristics associated with heavy oil diatomite formations precludes the use of conventional steam stimulation or drive processes, the Rivas method of alternating short steaming and production cycles is effective in recovering hydrocarbons from low permeability formations such as a diatomite matrix. However, the Rivas method, being a single well process, is limited to an operational area heated during the steam injection cycle, that area being adjacent to and surrounding the fractures extending from the wellbore; necessitating a large number of wells to process a given area since each single well will only recover a fraction of the original oil in place because of each well's limitation of only contacting and heating a small area away from the fracture due to the formation's extremely low permeability.

What is needed, therefore, is a steam drive method applicable to formations having low permeability and high oil viscosity, such as heavy oil diatomite formations, but not having the prohibitively large production response time inherent in conventional steam drive operations applied to such low permeability matrixes.

SUMMARY OF THE INVENTION

It is an object of the present invention to provide an improved steam drive method applicable to oil-bearing formations having a relatively low permeability.

Another object of the present invention is to provide an oil recovery method wherein the viscosity of the insitu oil within the production formation is initially lowered through a series of single well cyclic steaming operations. Still another object of the present invention is to provide an oil recovery method wherein a network of fractures are formed throughout the production interval of a producing formation during an initial cyclic steaming operation between two cyclic injectors, thereby providing thermal communication between established parallel vertical fracture planes.

These and other objectives are accomplished through the oil recovery method of the present invention, wherein a plurality of alternately disposed steam injection wells penetrate an oil-bearing formation in an elongated pattern along the formation's fracture orientation. Each well initiates a series of short steaming cycles at sufficient pressure to induce fracturing while minimizing steam loss to the surrounding formation. Each steaming cycle is in turn alternated With a production cycle, which exploits the reflashing of water to steam as the injection cycle ceases and the production cycle is initiated, to drive the oil from the formation to the induced fractures and ultimately up the wellbore. As each steam cycle is initiated and a fracture is induced, a heated zone around and extending from such fractures is also created. When thermal communication is established between the vertical fracture planes of the induced fractures, and oil recovery through the single well stimulation is significantly reduced, the cyclic steaming of each individual well is halted and the wells are converted to production wells. New injection wells, centrally situated between the production wells in a direction perpendicular to the fracture orientation, are then used to initiate a steam drive operation to push that oil not initially recovered during the cyclic steaming operation through the established thermal communication path, for recovery at the producing wells.

DETAILED DESCRIPTION OF THE INVENTION

There are two basic processes which use steam as a thermal energy agent for oil recovery. One of these is the steam drive process in which steam is injected into the formation at one well and petroleum is driven through the reservoir by the steam to an offset producing well. In this "steam drive" operation the steam acts as a vertical bank or wall in the formation, pushing the oil horizontally toward the producing well for recovery. The other process is a single well steam stimulation technique, particularly applicable in reservoirs where it is difficult to establish communication between two wells. In single well stimulation steam is injected, by means of the well, into the formation and subsequently the heated oil is withdrawn from the formation by means of the same well. These alternating injection and production cycles are repeated until oil can no longer be economically recovered.

By the method of the present invention the sweep efficiency of the steam drive operation is adapted for practical use in relatively impermeable formations in order to recover those hydrocarbons unaffected by the limited operational area heated through the single well steam stimulation techniques generally applicable to such formations. In practicing the present method the directional characteristics of hydraulically induced fractures are first determined from a first well utilizing any one of several techniques known in the art. For example, the monitoring of acoustic and seismic emissions from surface sites or downhole sensors during fracture propagation are typical of the systems used to indirectly map fracture characteristics. Similarly, impression packers as well as devices to measure surface upheaval, such as tiltmeters, are still further examples of methods known in the art for indirectly mapping fracture orientation. Alternatively, a direct measurement of the formation's fracture orientation may be obtained using any of several methods and apparatus known to those skilled in the art, such as the device taught by Shuck in U.S. Pat. No. 4,446,433 specifically incorporated herein by reference, wherein energy signals are directed, either in a phase detection, FM-swept frequency or pulse-echo ranging mode, through the induced fracture and processing the received signal to determine both the direction and length of the fracture propagation.

Figure 1:
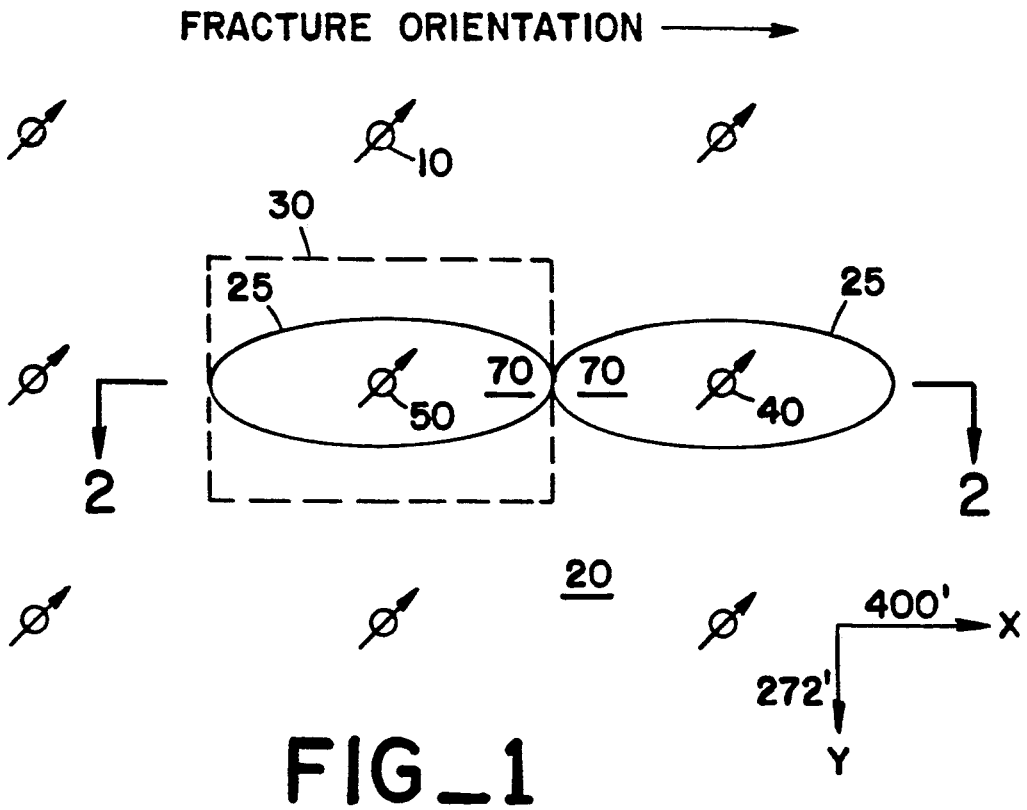
FIG. 1 depicts a planar view of the elongated rectangular configuration of the wellbores of the present method.
Figure 3:
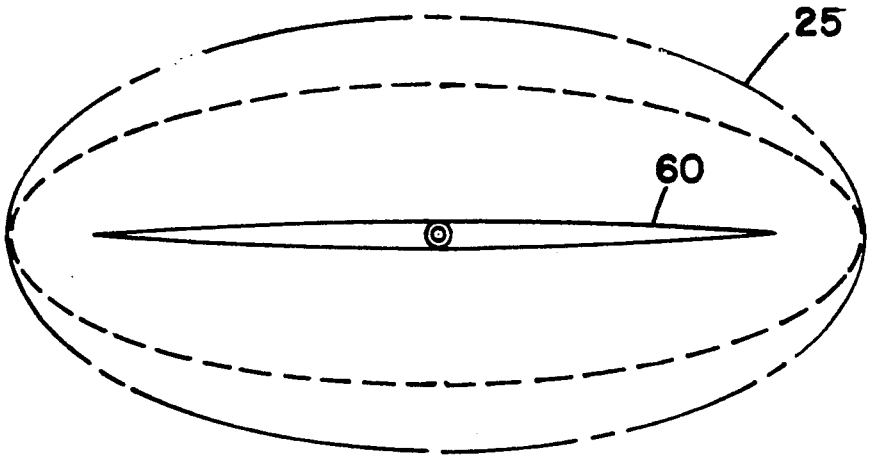
FIG. 3 depicts the heated zone surrounding a steam induced fracture.

Referring to FIG. 1 of the drawings, once the hydraulic fracture orientation of the reservoir has been determined, a plurality of wellbores 10 are drilled into the low permeability formation 20, traversing the oil bearing region of the formation, and established in an elongated rectangular line drive pattern along the formation's fracture orientation, preferably having a 1.25 acre spacing 30. Because the present method involves a fracturing of the formation, as later discussed herein, the elongated pattern is utilized to provide a better areal sweep within the formation; it being well recognized by those skilled in the art that thermal energy which passes through a fracture heats the area around the fracture thereby creating a heated zone resembling an ellipse with a high degree of eccentricity 25, more specifically depicted in FIG. 3. Well spacing within this elongated pattern will be dictated by the particular characteristics of the formation being exploited, and the formation's fracture half length, generally being within the range of about 200 feet. Once the well pattern is established, each well is operated in the steam stimulation process described in U.S. Pat. No. 5,085,276 to Rivas, which has been previously incorporated herein. The cyclic steaming operation described by Rivas involves the selection and perforation of a lower interval of each wellbore. Tubing is run into the respective wellbores with a thermal packer set at the upper boundary of the selected lower interval. Steam is then injected into each wellbore through the tubing at sufficient pressure and flow rate to cause a vertical fracturing of the adjacent formation. Steam injection is discontinued after about 3,000 to 5,000 barrels of steam has been placed in the selected interval. Following a brief soak period, the well is allowed to produce back from the first set of perforations, wherein the flashing of the highly pressurized water to steam, as a result of the reduction of wellbore pressure upon the initiation of the production cycle, is exploited as a means of driving in place hydrocarbons from the formation. Short steaming cycles, which prevent leakoff to the surrounding formation, alternating with production cycles are repeated for the first lower interval.

Figure 2:
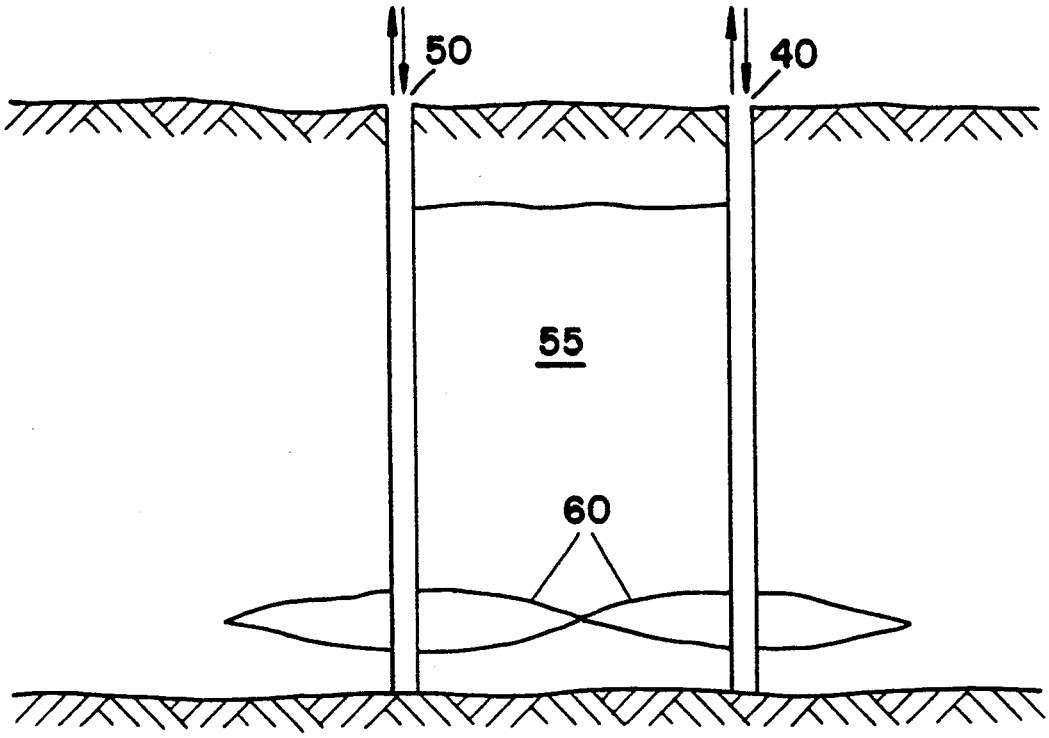
FIG. 2 depicts a sectional view of the wellbores shown in FIG. 1.

Referring now to FIG. 2 and the sectional view of the wellbores along reference line A—A of FIG. 1, it is generally recognized that hydraulic fractures induced by the steam injection process described by Rivas, will form along planes which are perpendicular to the least one of the three principle compressive stresses which exist along the Vertical and two mutually perpendicular axes within the formation between the two cyclic injectors 40 and 50 traversing production interval 55. In tectonically inactive regions the least principle stress is substantially horizontal, resulting in induced fractures 60 that are substantially vertical planer fractures. In recognition of this fact Rivas teaches the selection and isolation of subsequent intervals within the formation, each being worked by the steam stimulation technique previously described, until a plurality of vertical fracture planes is developed for each well within the multiple well field.

Once this set of aligned vertical fractures is established, short steaming and production cycles for each well are continued until thermal communication between the parallel vertical fracture planes of each well is established. It being generally recognized that during the cyclic steaming operation heat will outwardly propagate, as shown by heated zone 70 of FIG. 1, from the fracture due to both convective and diffusive heating as each injection cycle is completed. For wells 40 and 50 of FIG. 1 on a 1.25 acre spacing, having a 200 foot fracture half length, thermal communication will generally be established after about 20 to 40 cycling operations through the combination of conductive heating through the diatomite matrix, and convective transfer of heat as a result of fluid flow through the diatomite. The fluid flow itself being the result of the pressure gradient established during steam injection and hot water inhibition.

Figure 4A:
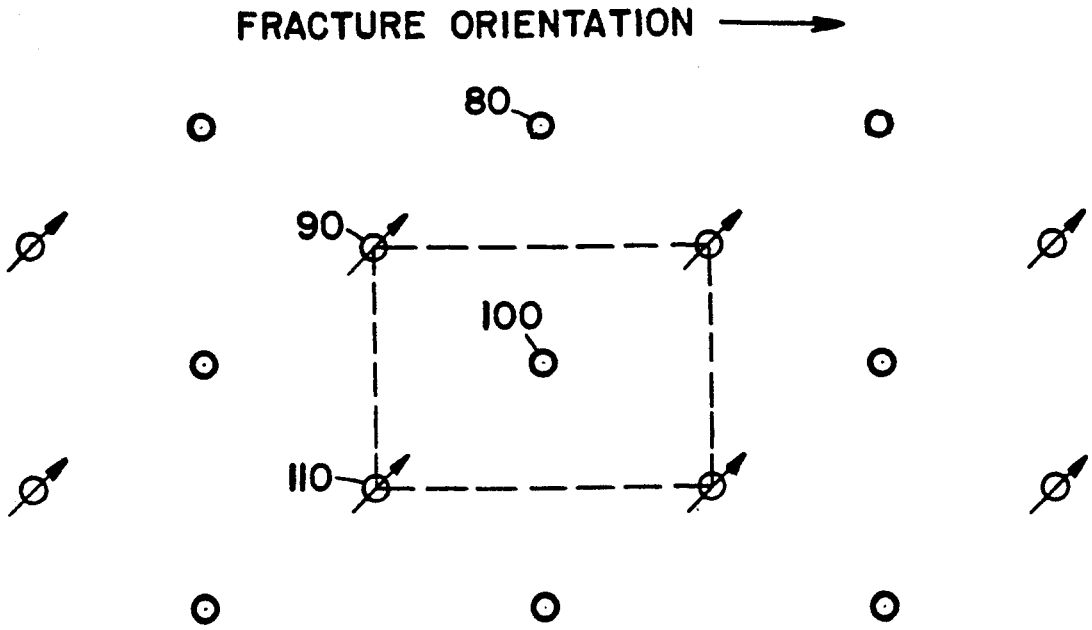
FIG. 4*a* depicts a staggered line drive pattern injector configuration used in the present method.
Figure 4B:
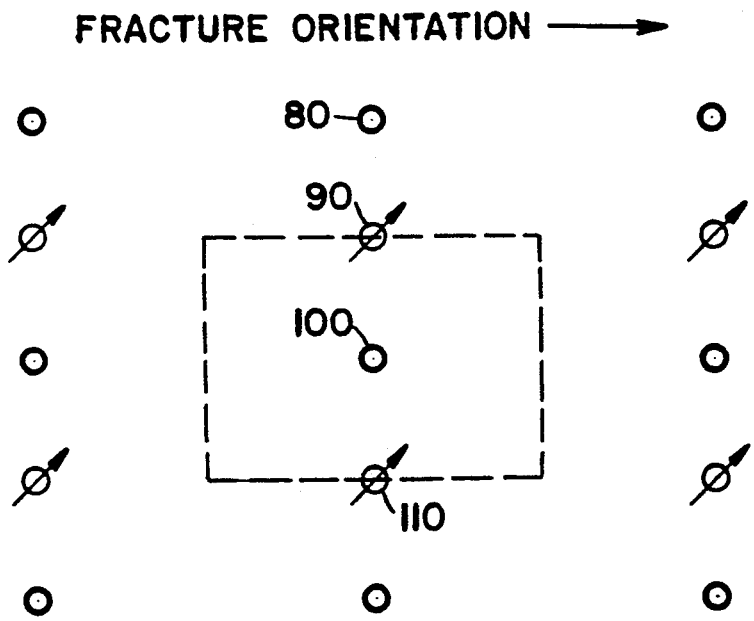
FIG. 4*b* depicts a direct line drive pattern injector configuration used in the present method.

Once the above described steps of steam stimulation no longer yields sufficient oil production and thermal communication is established in the formation via the fractured cyclic steaming operation, the resulting reduction in insitu oil viscosity within the formation is exploited by initiating a steam drive through newly drilled rows of injection wells centrally positioned between the existing wells perpendicular to the fracture orientation, wherein the existing wells are then converted to producers as depicted in FIGS. 4*a* and 4*b*. In this particular configuration wells 80 and 100 are production wells while wells 90 and 110 are steam injection wells undergoing fracturing by steam injected above fracture pressure, each extending through the relatively impermeable diatomite formation. In FIG. 4*a*, the injector configuration depicted is that of a staggered line drive pattern, where in FIG. 4*b* an alternate injector configuration is depicted of a direct line drive pattern.

Figure 5:
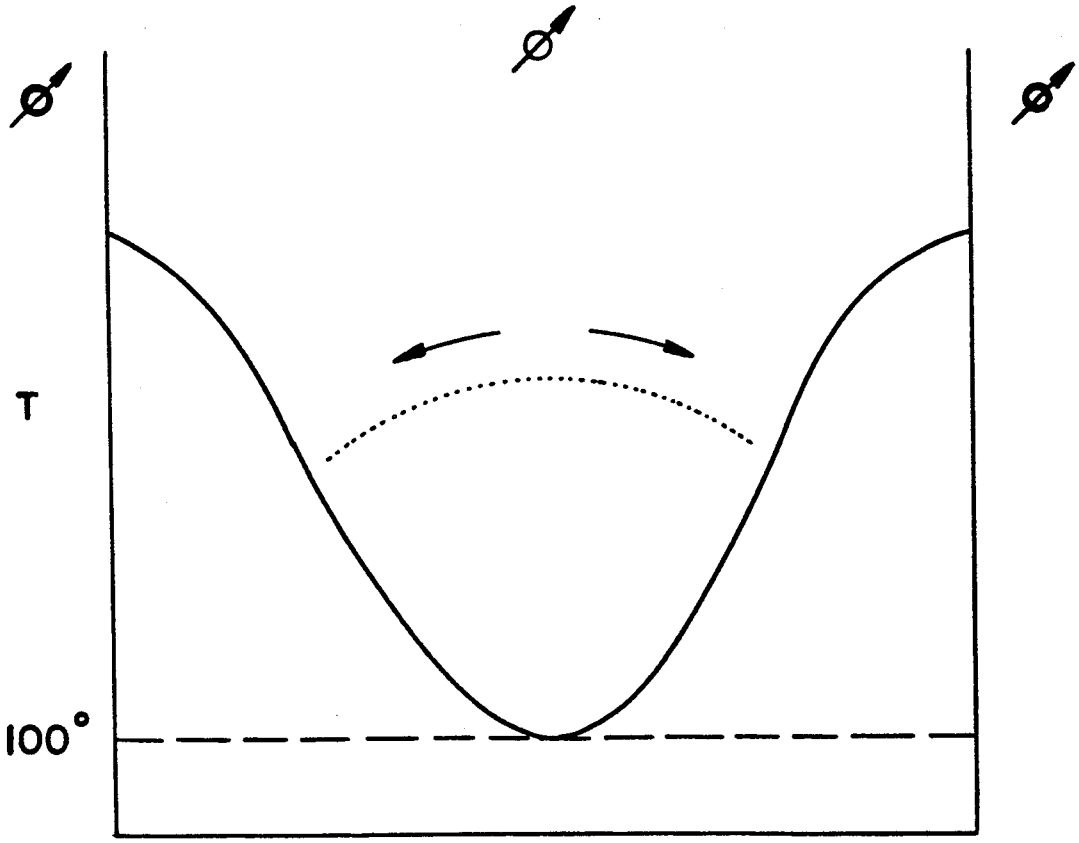
FIG. 5 depicts a temperature profile, prior to steam injection, of the formation between two production wells having a new centrally located injection well.

The formation interval between wells, having been preheated, provides a unique and advantageous type of heated reservoir zone in which to conduct a steam drive. If the interwell distance perpendicular to the fracture orientation is approximately equivalent to the width of the zone heated by the injected steam the temperature profile depicted in FIG. 5 will be repeated between each row of wells in the field. As the hot steam is injected into the formation through the newly established injection wells, the steam heats the low temperature, high viscosity oil nearest the injector, as depicted in FIG. 5, and displaces it toward the higher temperature area surrounding the converted producer. It is the reservoir heating between the two fracture planes during the steam stimulation which causes the significant viscosity reduction, as evidenced by the viscosity reduction of two differing crude oils shown in Table I below, which assists in providing the mobility needed for a successful steamdrive. If the reservoir is not heated by cyclic steam stimulation prior to initiating the steamdrive, the high crude oil viscosity at reservoir conditions, coupled with the low reservoir permeability of the diatomite, will result in excessively long production response times, making the steamdrive economically unsuccessful.

TABLE I

CRUDE OIL VISCOSITY

| Temperature. °F. | Viscosity (centipose) Crude A | Crude B |
|---|---|---|
| 70.5 | 15,950 | — |
| 75 | — | 4,200 |
| 90 | 4,285 | — |
| 100 | 2,380 | 1,100 |
| 150 | 245 | 130 |
| 200 | 54 | 33 |
| 250 | 18.9 | 12.5 |
| 300 | 8.8 | 6.4 |
| 350 | 4.9 | 3.8 |
| 400 | 3.1 | 1.6 |

In this way in-situ oil not initially recovered through steam stimulation efforts can be mobilized in a fracture steam drive operation, heretofore impractical in relatively impermeable formations.

In an alternate embodiment, the initial well configuration for the steam stimulation phase of the present method is either a staggered line drive or direct line-drive pattern is previously discussed and depicted in FIG. 4*a* and 4*b*. As with the previous embodiment, fracture steam stimulation is carried out until oil recovery in the wells is significantly reduced and the reservoir is sufficiently heated and thermal communication between the fractures is established. To initiate the steamdrive alternate rows of wells are converted to production wells while the remaining wells are converted to injection wells. For this alternate embodiment the coldest oil lies between the injector and producer rows, With the zones nearest the injectors and producers having the highest temperature. As the steam drive moves the oil bank, the centrally located cooler portion of the oil bank is heated primarily by the injected steam as well as by contact with the hotter reservoir formation section surrounding the fractures into which the oil is pushed.

In each of the previously described processes a single vertical fracture was created in each well during the cyclic steam stimulation phase. Because the fracture heights are typically between 40 and 70 feet, and the formation itself being generally over 300 feet, the benefit from a single fracture is recognized as being limited. To process the remaining formation in accordance with the present method two approaches can be used. In one method, after the lowest zone has been processed it is plugged back and another set of parallel vertical fractures is created in a zone located above the initial zone, and the entire process of cyclic steam stimulation followed by a steam drive, as previously described, is repeated. In an alternate method the processing of the entire formation is accomplished by creating in each of the wells a plurality of aligned, generally parallel vertical fractures as taught by Rivas, to cover the entire production interval. Each interval is worked by the steam stimulation technique as previously described until a plurality of vertical fracture planes is developed within each well, wherein the multiple vertical fractures undergo the alternating steaming and production sequence detailed in the single fracture embodiments. After oil recovery from the single well stimulation is no longer practical, and formation heating through the fracture network is established, all the parallel sets of fractures are simultaneously steam driven as previously described.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A method of improving oil production from a relatively impermeable formation utilizing a steam drive, said method comprising:

determining a hydraulic fracture orientation for the formation:

drilling and casing a plurality of first wellbores in an elongated pattern along the fracture orientation;

cyclically injecting into each of said wellbores an amount of steam in a short steaming cycle sequence sufficient to heat the formation through a plurality of controllably induced vertical formation fractures created throughout a production interval, while minimizing leakoff from said fractures outside the formation, and cyclically producing formation hydrocarbons upon cessation of a steam injection cycle by reflashing said steam through the wellbore;

continuing to alternate steam injection and hydrocarbon production from each wellbore until a thermal communication is established between adjacent wellbores;

drilling a plurality of second injection wells centrally interposed between the first wellbores, and converting said first wellbores to production wells; and initiating a fracture steam drive by injecting steam above fracture pressure into each of the second wells, wherein formation hydrocarbons initially mobilized by said steam drive and heated by contacting heated formation sections around the induced fractures, thereby allowing further hydrocarbons mobilization for recovery at the production wells.

2. The method of claim 1 wherein the amount of steam cyclically injected is between 2000 and 5000 Barrels CWE per day.

3. The method of claim 1 wherein the relatively impermeable formation is diatomite.

4. The method of claim 1 wherein the elongated pattern is a rectangular line drive pattern.

5. The method of claim 1 wherein the elongated pattern is a staggered line drive.

6. A method of improving oil production from a relatively impermeable formation utilizing a steam drive, said method comprising:

determining a hydraulic fracture orientation for the formation;

drilling and casing a plurality of wellbores in an elongated pattern along the fracture orientation;

cyclically injecting into each of said wellbores an amount of steam in a short steaming cycles sequence sufficient to heat the formation through a plurality of controllably induced vertical formation fractures created throughout a production interval, while minimizing leakoff from said fractures outside the formation, and cyclically producing formation hydrocarbons upon cessation of a steam injection cycle by reflashing said steam through the wellbore;

continuing to alternate steam injection and hydrocarbon production from each wellbore until a thermal communication is established between adjacent wellbores;

converting each alternate wellbore to a production well and Converting each remaining wellbore to an injection well;

initiating a steam drive by injecting steam into each of the injection wells wherein formation hydrocarbons initially mobilized by said steam drive are heated by contacting heated formation sections around the induced fractures, thereby allowing further hydrocarbon mobilization for recovery at the production wells.

7. The method of claim 6 wherein the relatively impermeable formation is diatomite.

8. The method of claim 6 wherein the elongated pattern is a rectangular line drive pattern.

9. The method of claim 6 wherein the elongated pattern is a staggered line drive pattern.

* * * * *